United States Patent [19]

Tokuue et al.

[11] 3,996,076

[45] Dec. 7, 1976

[54] PROCESS FOR QUENCH HARDENING WITH POLYACRYLATE QUENCHING MEDIUM

[75] Inventors: Takashi Tokuue, Yokohama; Takashi Kato, Yokosuka, both of Japan

[73] Assignee: Toho Chemical Industry Co., Ltd., Tokyo, Japan

[22] Filed: June 4, 1975

[21] Appl. No.: 583,538

Related U.S. Application Data

[62] Division of Ser. No. 402,781, Oct. 2, 1973, Pat. No. 3,939,016.

[30] Foreign Application Priority Data

Oct. 2, 1972 Japan ..... 47-97969

[52] U.S. Cl. ..... 148/18; 148/27; 148/28; 252/67; 252/72

[51] Int. Cl.[2] ..... C21D 1/48; B23K 35/24

[58] Field of Search ..... 148/27, 28, 29, 20.6, 148/18; 252/72, 76, 79, 67; 260/29.6 WB

[56] References Cited

UNITED STATES PATENTS

| | | | |
|---|---|---|---|
| 2,600,290 | 6/1952 | Corneil | 148/18 |
| 2,770,564 | 11/1956 | Gordon | 148/30 |
| 3,022,205 | 2/1962 | Chase et al. | 148/20.6 |
| 3,939,016 | 2/1976 | Tokuue et al. | 148/28 |

*Primary Examiner*—Walter R. Satterfield
*Attorney, Agent, or Firm*—Armstrong, Nikaido & Wegner

[57] ABSTRACT

A process for quench hardening metal is provided. The process comprises heating the metal to a quench hardening temperature and thereafter immersing the metal in a quenching medium which is an aqueous solution containing 0.4 to 10% by weight of polyacrylic acid, polymethacrylic acid, a copolymer of acrylic acid and methacrylic acid, or a salt thereof. The process provides a perfect and uniformly hardened quenched structure and allows the production of a quenched structure having a desired degree of hardness.

6 Claims, No Drawings

PROCESS FOR QUENCH HARDENING WITH POLYACRYLATE QUENCHING MEDIUM

This is a division of application Ser. No. 402,781, filed Oct. 2, 1973, now U.S. Pat. No. 3,939,016.

This invention relates to a medium for quenching carbon steel, alloy steel and other metals.

Conventional quenching media have some weaknesses. For example, when a low carbon steel is quenched in water, the carbon steel is cooled too rapidly and hence, internal strain or a quenching crack often occurs in the carbon steel. Therefore, when water is employed as a quenching medium, complicated procedures are required such as interrupted quenching. When a high carbon steel is quenched in oil, the carbon steel is imperfectly quenched and soft spots occur on the carbon steel.

Heretofore, various quenching media have been proposed in order to remove such weaknesses. However, these quenching media have a few of the following weaknesses. (1) They are generally short-lived. (2) Steel still tends to be imperfectly quenched in these media and soft spots and other defects often occur on the material. (3) An offensive odor is emitted when materials are quenched in these media, and it is troublesome to treat waste quenching media for disposal.

It is an object of the present invention to provide a quenching medium which does not cause quenching strain and soft spots and produces a perfect and uniformly hardened structure.

It is another object of the present invention to provide a quenching medium capable of producing a quenched structure having a desired degree of hardness, ranging from a low hardness equal to or less than that obtained with quenching oils to a high hardness equal to that obtained with water.

It is a further object of the present invention to provide a quenching medium which does not emit an offensive odor or a harmful gas during quenching, and which is capable of being disposed as it is when its life span is completed.

It is a still further object to provide a quenching medium by which quench hardening can be achieved within a relatively short period of time.

In accordance with the present invention, there is provided a quenching medium comprising an aqueous solution containing 0.4 to 10% by weight of at least one polymer selected from polyacrylic acid, polymethacrylic acid, a copolymer of methacrylic acid and acrylic acid and salts thereof, said polymer having an intrinsic viscosity $[\eta]$ of 0.010 to 0.050 l/g.

The quenching medium of the present invention is an aqueous solution of water-soluble polymers such as polyacrylic acid, polymethacrylic acid, a copolymer of acrylic acid and methacrylic acid, and salts thereof. The salts include for example those of sodium, potassium, triethanolamine, ammonium and the like.

Of these water-soluble polymers, those in the form of salt are preferable as compared with those in the form of free acid from the viewpoints of H-value, thermal stability, corrosion embrittlement and ease in treatment of the waste liquid. Particularly, sodium and potassium salts are preferable.

Optimum results are obtainable with a mixture of 40 to 60% by weight of sodium or potassium polyacrylate and 60 to 40% by weight of sodium or potassium poly(acrylate-methacrylate). When the relative amount of sodium or potassium poly(acrylate-methacrylate) is in excess of the above range, a steam film is prone to cover the piece of steel over a relatively increased period of time in the quenching medium and, on rare occasions, imperfect quenching is caused. In contrast, when the relative amount of sodium or potassium poly(acrylate-methacrylate) is below the above range, the quenching velocity of steel at the martensite starting (Ms) point is prone to become excessively high and, on rare occasions, a quenching crack occurs on the quenched structure.

The water-soluble polymers should have an intrinsic viscosity $[\eta]$ of 0.010 to 0.050 l/g, preferably 0.020 to 0.045 l/g. By the term "intrinsic viscosity" used herein is meant that determined in water at a temperature of 25° C. When the intrinsic viscosity $[\eta]$ of the water soluble polymer is less than 0.010 l/g, the quenching medium has a high H-value practically equal to that of water. In this case, the cooling velocity of steel cannot be desirably reduced at the martensite starting (Ms) point, even when the concentration of the water-soluble polymer in the quenching medium is increased. In contrast, when the intrinsic viscosity $[\eta]$ of the water-soluble polymer is higher than 0.050 l/g, a steam film inevitably covers the piece of steel over a long period of time in the quenching medium, leading to the lapse of quenching and the imperfect quenching.

The concentration of the water-soluble polymer in the quenching medium is 0.4 to 10% by weight, preferably 0.5 to 6.0% by weight. When the concentration is less than 0.5% by weight, the quenching medium exhibits a high H-value practically equal to that of water, and a quenching crack is prone to occur although the quenched product has an increased hardness. In contrast, when the concentration is in excess of 10% by weight, the quenching medium is inferior in thermal transmission and hence has an excessively low H-value.

When a piece of austenitized steel is immersed in the quenching medium of the invention, the water-soluble polymer dissolved in the quenching medium envelopes the piece and prevents the transmission of heat, and hence desirably reduces the cooling velocity of steel at the vicinity of the martensite starting point. Thus, the quenching medium produces a hardened structure having no quenching strain and quenching crack.

The following examples are given to illustrate the invention and not to be considered as limiting in any sense.

In the examples, hardness of the quenched product was determined on the surface and the core thereof according to Japanese Industrial Standard (hereinafter referred to as "JIS" for brevity) Z 2245 and expressed as Rockwell hardness C scale. Two numerical values given in the columns showing the hardness of the surface of the quenched product mean the minimum hardness and the maximum hardness obtained when determined on seven points on the surface of the quenched product.

Occurence of quenching cracks was determined by a magnetic particle testing method for ferro-magnetic materials stipulated in JIS G 0565.

Quenching imperfection was determined by examining the quenched specimen microscopically.

Two numerical values showing the temperature of the quenching medium mean the temperature immediately before the steel specimen is immersed in the quenching medium and the temperature after the steel specimen is quenched in the medium, respectively.

All % are % by weight.

EXAMPLE 1

Round bars of carbon steel SAE 1045, each having a 25 mm diameter and a 50 mm length were quenched under the following conditions.

Austenitization: at 850° C for 40 minutes
Quenching temperature: 850° C
Quenching medium:
- Medium 1-A: 1.0% aqueous solution of a 1 : 1 mixture of sodium polyacrylate having an intrinsic viscosity [η] of 0.0234 l/g and sodium poly(acrylate-methacrylate)*1 having an intrinsic viscosity [η] of 0.0396 l/g
- Medium 1-B: 1.6% aqueous solution of a polymer mixture quite similar to the above
- Medium 1-C: 3.0% aqueous solution of a polymer mixture quite similar to the above
- Medium 1-D: City water
- Medium 1-E: Quenching oil designated No. 1—1 according to JIS K 2242

Note: *1 Copolymer containing 70% of sodium acrylate and 30% of sodium methacrylate Volume of quenching medium: 5 l
Temperature of quenching medium: 28° – 32° C Hardness of the quenched bars was tested. Results are shown in Table I.

Table I

| Medium | Hardness of surface | Hardness of core |
|---|---|---|
| 1-A | 60.0 – 60.9 | 46.5 |
| 1-B | 56.0 – 57.6 | 45.2 |
| 1-C | 28.5 – 31.6 | 27.5 |
| 1-D (Control) | 59.5 – 62.6 | 45.2 |
| 1-E (Contron) | 25.4 – 28.4 | 27.0 |

EXAMPLE 2

Round bars of chromium-molybdenum steel SAE 4135, each having a 25 mm diameter and a 50 mm length were quenched under the following conditions.

Austenitization: at 850° C for 40 minutes
Quenching temperature: 850° C
Quenching medium:
- Medium 2-A: 1.0% aqueous solution of a 1 : 1 mixture of sodium polyacrylate quite similar to that used in Example 1 and sodium poly(acrylate-methacrylate) quite similar to that used in Example 1
- Medium 2-B: 4.0% aqueous solution of a polymer mixture quite similar to the above
- Medium 2-C: 4.6% aqueous solution of a polymer mixture quite similar to the above
- Medium 2-D: City water
- Medium 2-E: Quenching oil designated No. 1—1 according to JIS K 2242.

Volume of quenching medium: 5 liters
Temperature of quenching medium: 28° – 32° C Hardness of the quenched bars was tested. Results are shown in Table II.

Table II

| Medium | Hardness of surface | Hardness of core |
|---|---|---|
| 2-A | 58.1 – 60.2 | 59.9 |
| 2-B | 52.4 – 54.6 | 50.5 |

Table II-continued

| Medium | Hardness of surface | Hardness of core |
|---|---|---|
| 2-C | 49.2 – 53.3 | 50.3 |
| 2-D (Control) | 60.5 – 61.3 | 60.6 |
| 2-E (Control) | 52.5 – 56.1 | 57.3 |

EXAMPLE 3

A main arm (a part of automobile) of chromium-molybdenum steel SAE 4135 and a coil spring of carbon tool steel SAE W108 were quenched under the following conditions.

Austenization: at 850° C for 50 minutes for the main arm; at 950° C for 3 minutes for the coil spring
Quenching temperature: 850° C for the main arm, and 950° C for the coil spring
Quenching medium:
- Medium 3-A: 3.0% aqueous solution of a polymer mixture quite similar to that used in Example 1
- Medium 3-B: City water Temperature of quenching medium: 28° – 50° C Hardness of the surface of the quenched structures was as follows.

| Medium | Hardness of surface | |
|---|---|---|
| | Main arm | Coil spring |
| 3-A | 58.4 – 59.5 | 61.0 – 63.2 |
| 3-B | 51.2 – 53.4 | 60.8 – 63.8 |

A quenching crack was found in the main arm and the coil spring, both quenched in city water (3-B). In contrast, no cracks were found in the main arm and the coil spring both quenched in the aqueous solution (3-A) of the mixture of sodium polyacrylate and sodium poly(acrylate-methacrylate), although both the main arm and the coil spring had hardnesses higher than those quenched in city water.

The occurrence of a crack in the coil spring was determined with the unaided eye.

EXAMPLE 4

Round bars of carbon steel SAE 1045, each having a 25 mm diameter and a 50 mm length, and round bars of chromium-molybdenum steel SAE 4135, each having the same diameter and length as the above, were quenched under the following conditions.

Austenization: at 850° C for 40 minutes
Quenching temperature: 850° C
Quenching medium:
- Medium 4-A: 10.0% aqueous solution of a polymer mixture quite similar to that used in Example 1
- Medium 4-B: Quenching oil designated No. 1—1 according to JIS K 2242

Volume of quenching medium: 5 l
Temperature of quenching medium: 850° C

Hardness of the surface of the quenched bars was as follows.

| Medium | Hardness of surface Carbon steel | Cr-Mo Steel |
|---|---|---|
| 4-A | 10.0 – 13.7 | 35.5 – 40.0 |
| 4-B | 25.4 – 28.4 | 52.5 – 56.1 |
| | 7.8 – 8.3* | 17.0 – 18.5* |

Note:
*Hardness of the surface of the specimen determined before the quenching

As shown above, the quenching medium containing the polymer at a relatively high concentration is capable of providing a quenched structure having a hardness less than that of a structure of quenched in oil.

EXAMPLE 5

Main arms of chromium-molybdenum steel SAE 4135 were quenched under the following conditions.

Austenitization: at 850° C for 50 minutes
Quenching temperature: 850° C
Quenching medium:
- Medium 5-A: 1.5% aqueous solution of polyacrylic acid having an intrinsic viscosity [η] of 0.0234 l/g
- Medium 5-B: 1.5% aqueous solution of a copolymer of 70% acrylic acid and 30% methacrylic acid, having an intrinsic viscosity [η] of 0.0396 l/g
- Medium 5-C: 1.5% aqueous solution of a 1 : 1 mixture of polyacrylic acid quite similar to that of Medium 5-A and a copolymer quite similar to that of Medium 5-B
- Medium 5-D: 1.5% aqueous solution of potassium polyacrylate having an intrinsic viscosity [η] of 0.0234 l/g
- Medium 5-E: 1.5% aqueous solution of potassium salt of a copolymer of 70% acrylic acid and 30% methacrylic acid, having an intrinsic viscosity [η] of 0.0396 l/g
- Medium 5-F: 1.5% aqueous solution of a 1 : 1 mixture of potassium polyacrylate quite similar to that of Medium 5-D and a copolymer quite similar to that of Medium 5-E
- Medium 5-G: 1.5% aqueous solution of a triethanolamine salt of polyacrylic acid, having an intrinsic viscosity [η] of 0.0234 l/g
- Medium 5-H: 1.5% aqueous solution of a triethanolamine salt of a copolymer of 70% acrylic acid and 30% methacrylic acid, having an intrinsic viscosity [η] of 0.0396 l/g
- Medium 5-I: 1.5% aqueous solution of a 1 : 1 mixture of a triethanolamine salt of polyacrylic acid quite similar to that of Medium 5-G and a triethanolamine salt of a copolymer quite similar to that of Medium 5-H
- Medium 5-J: Quenching oil designated No. 1—1 according to JIS K 2242
- Medium 5-K: City water
- Medium 5-L: 1.5% aqueous solution of polymethacrylic acid having an intrinsic viscosity [η] of 0.0230 l/g
- Medium 5-M: 1.5% aqueous solution of potassium polymethacrylate having an intrinsic viscosity [η] of 0.0230 l/g
- Medium 5-N: 1.5% aqueous solution of a triethanolamine salt of polymethacrylic acid, having an intrinsic viscosity [η] of 0.0230 l/g Volume of quenching medium: 5 l
Temperature of quenching medium: 28° – 32° C Hardness of and occurrence of crack in the quenched main arms are shown in Table III.

Table III

| Medium | Hardness of surface | Hardness of core | Occurrence of crack |
|---|---|---|---|
| 5-A | 59.5 – 61.2 | 60.4 | not found |
| 5-B | 59.8 – 61.0 | 59.0 | " |
| 5-C | 59.3 – 60.8 | 59.5 | " |
| 5-D | 58.5 – 59.2 | 58.8 | " |
| 5-E | 58.5 – 59.5 | 58.3 | " |
| 5-F | 58.8 – 59.6 | 58.5 | " |
| 5-G | 59.0 – 60.1 | 59.3 | " |
| 5-H | 59.3 – 61.0 | 60.7 | " |
| 5-I | 58.5 – 59.5 | 59.5 | " |
| 5-J (Control) | 52.5 – 58.1 | 57.3 | " |
| 5-K (Control) | 58.5 – 61.3 | 60.6 | found |
| 5-L | 59.3 – 61.3 | 59.4 | not found |
| 5-M | 58.8 – 59.9 | 59.0 | " |
| 5-N | 59.5 – 60.4 | 60.0 | " |

EXAMPLE 6

Main arms of chromium-molybdenum steel SAE 4135 were quenched in a bath of 3% aqueous solution of a 1 : 1 mixture of sodium polyacrylate and sodium poly(acrylate-methacrylate), both having various intrinsic viscosities as shown in Table IV below, under the following conditions.

Austenization: at 850° C for 50 minutes
Quenching temperature: 850° C
Volume of quenching medium: 5 l
Temperature of quenching medium: 28° – 32° C Table IV

| Medium | Intrinsic viscosity of polymer Mixture | SPA*6 | SPA-M*7 | Hardness of surface | State of quenched structure |
|---|---|---|---|---|---|
| 6-A (Control) | City water | | | 60.5 – 62.5 | Crack*1 |
| 6-B | 0.0088 | 0.0092 | 0.0085 | 59.8 – 61.0 | Crack*2 |
| 6-C | 0.0125 | 0.0092 | 0.0133 | 58.1 – 60.2 | No crack*3 |
| 6-D | 0.0268 | 0.0230 | 0.0370 | 55.4 – 57.8 | " |
| 6-E | 0.0340 | 0.0234 | 0.0396 | 52.6 – 54.3 | " |
| 6-F | 0.0495 | 0.0330 | 0.0522 | 51.0 – 53.3 | " |
| 6-G (Control) | 0.0518 | 0.0420 | 0.0550 | 49.2 – 54.5 | No crack*4 but imperfect quenching |
| 6-H (Control) | Quenching oil*5 | | | 50.5 – 56.3 | " |

Note:
*1Cracks were found in all ten of the specimens employed.
*2Cracks were found in two of the ten specimens employed.
*3No cracks were found in any of the ten specimens employed.
*4No cracks were found in any of the ten specimens employed, but quenching imperfection was observed in two of the ten specimens.
*5Quenching oil designated No. 1–1 according to JIS K 2242
*6SPA: Sodium polyacrylate
*7SPA-M: Sodium poly(acrylate-methacrylate)

What we claim is:

1. A process for quench hardening metal comprising heating the metal to a quench hardening temperature and thereafter immersing said metal in a quenching medium consisting essentially of an aqueous solution containing 0.4 to 10% by weight of at least one polymer selected from polyacrylic acid, polymethacrylic acid, a copolymer of methacrylic acid and acrylic acid, and salts thereof, said polymer having an intrinsic viscosity [η] of 0.010 to 0.050 l/g/.

2. The process of claim 1 wherein said salts are the salts of sodium, potassium, triethanolamine and ammonium.

3. The process of claim 1 wherein said polymer has an intrinsic viscosity [η] of 0.020 to 0.045 l/g.

4. The process of claim 1 wherein the concentration of said polymer in the aqueous solution is from 0.5 to 6.0% by weight.

5. The process of claim 1 wherein said polymer is a sodium or potassium salt of polyacrylic acid, polymethacrylic acid or a copolymer of acrylic acid and methacrylic acid.

6. The process of claim 1 wherein said polymer is a mixture consisting essentially of 40 to 60% by weight of sodium or potassium polyacrylate and 60 to 40% by weight of a sodium or potassium salt of a copolymer of acrylic acid and methacrylic acid.

* * * * *